US010420434B1

(12) United States Patent
Juarbe

(10) Patent No.: US 10,420,434 B1
(45) Date of Patent: Sep. 24, 2019

(54) DRINKING STRAW WITH A DISPLAY ARRANGEMENT

(71) Applicant: Israel Juarbe, Bronx, NY (US)

(72) Inventor: Israel Juarbe, Bronx, NY (US)

( * ) Notice: Subject to any disclaimer, the term of this patent is extended or adjusted under 35 U.S.C. 154(b) by 0 days.

(21) Appl. No.: 16/144,835

(22) Filed: Sep. 27, 2018

Related U.S. Application Data

(63) Continuation-in-part of application No. 15/477,604, filed on Apr. 3, 2017, now Pat. No. 10,085,576.

(51) Int. Cl.
*A47G 19/22* (2006.01)
*A47G 21/18* (2006.01)

(52) U.S. Cl.
CPC ..... *A47G 21/182* (2013.01)

(58) Field of Classification Search
CPC ..... A47G 21/186; A47G 21/182; A47G 19/2272; A47G 19/22
USPC ..... 220/710, 705
See application file for complete search history.

(56) References Cited

U.S. PATENT DOCUMENTS

2008/0203104 A1* 8/2008 Pawlik ..... A47G 19/2222 220/710

* cited by examiner

*Primary Examiner* — King M Chu
(74) *Attorney, Agent, or Firm* — Lawrence G. Fridman, Esq.; Feigin & Fridman, LLC

(57) ABSTRACT

A drinking straw has a display arrangement mounted thereon or attached thereto, where the display arrangement bears a graphic representation, such as an advertisement or an amusing graphic representation. When the drinking straw is disposed within a cup, the display arrangement is adapted to engage an exterior surface of the cup, so that the straw remains upright in the cup adjacent the side thereof.

14 Claims, 13 Drawing Sheets

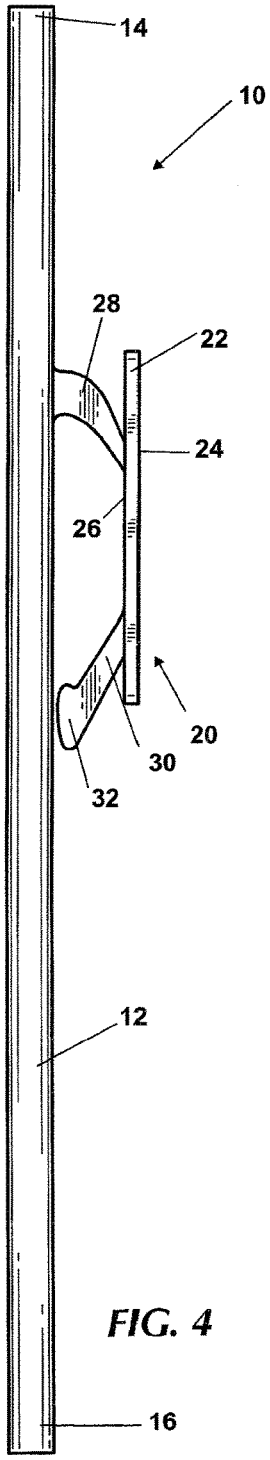
FIG. 4
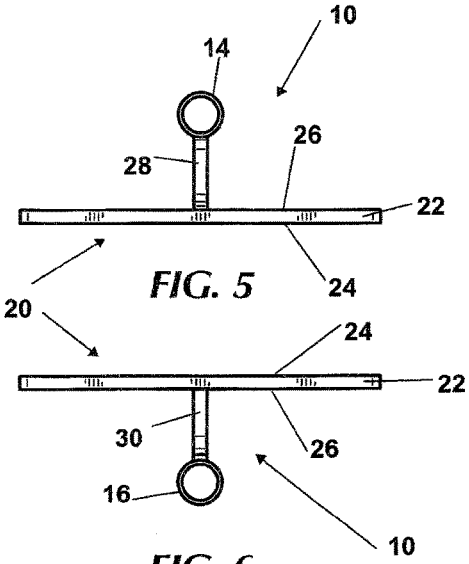
FIG. 5
FIG. 6
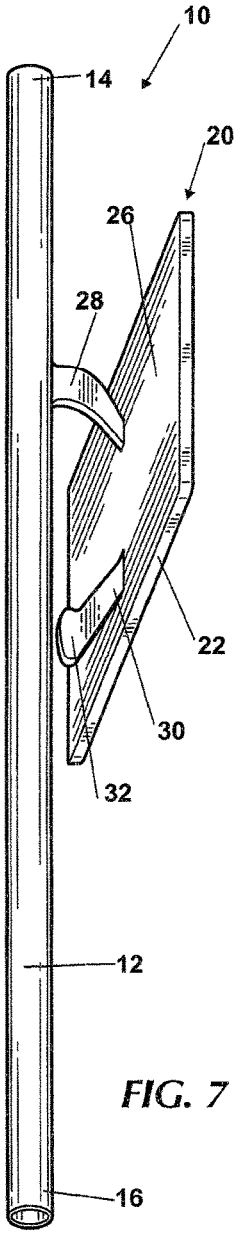
FIG. 7

DRINKING STRAW WITH A DISPLAY ARRANGEMENT

REFERENCE TO RELATED APPLICATION

This Application is a continuation-in-part Application of Application Ser. No. 15/477,604 filed Apr. 3, 2017, the entire disclosure of which is hereby incorporated by reference.

FIELD AND BACKGROUND OF THE DISCLOSED TECHNOLOGY

The disclosed technology relates generally to drinking straws, and, more specifically, to a drinking straw including a display arrangement for displaying a language or graphic representation thereon, the drinking straw being connectable to the side of a drinking cup.

U.S. Pat. No. 5,427,315 to Lipson is directed to a drinking straw which includes a planar insert for display of amusement or advertising indicia thereon. The straw includes a drinking tube having linearly extending first and second ends, and a loop disposed therebetween, A planar insert is attached to the loop by means of a first cutout portion through which an attachment portion of the loop passes.

U.S. Pat. No. 4,724,518 to Martina et al is directed to a straw for sucking beverages which can be utilized to convey advertising information and messages. The straw includes a panel having two opposing flat major faces, a plurality of channels extending between the major faces and having open ends at opposite edges of the panel, and at least one liquid suction region and liquid pickup region which are formed at the edges and interconnected by at least two of the channels.

U.S. Pat. No. 5,046,628 to Florjancic is directed to a complicated and difficult to manufacture device for holding straws which is not easy to assemble and apply by a consumer. This device is not stable and therefore can not be used for the purposes of the invention, especially when it has to support an electronic display element discussed in the application.

However, none of the straw arrangements discussed above discloses a simple, economical and ready to use device with a display arrangement capable of displaying a graphic or any other representation visible to the consumer or other individuals in his or her vicinity. Thus, it has been long felt and unsolved need to provide simple, economical and ready to use drinking straw holding device with a display arrangement capable of displaying language and/or graphic information, that can be attached to the side of a cup, while a user is utilizing the straw to drink.

SUMMARY OF THE DISCLOSED TECHNOLOGY

The disclosed technology relates generally to drinking straws and, more specifically, to drinking straws that are attachable to the side of a cup and have a language and graphic representation visible thereon.

According one aspect of the invention there is provided a drinking straw holding device with a display arrangement which includes a unitary body having a display element, a straw attachment module and a cup engagement unit, the display element is formed with a content-bearing exterior area and an interior area accommodating the straw attachment module and the cup engagement unit; the straw attachment module extends between a rear region connected to the interior area of the display element and a front region, the straw attachment module is formed by a first wall and a second wall partially are separated from each other at the front region by an operational gap; at the rear region the first and second walls are joined by a connecting area connected to the interior area.

According to another aspect of the invention the cup engagement unit is formed within a longitudinal space extending downwardly from the connecting area and separating the first and walls from the interior area, and a tongue member extends downwardly from the connecting area to separate the longitudinal space into a first receiving space and a second receiving space.

According to a further aspect of the invention the first receiving space is formed between an inner area of the walls and the tongue member and the second receiving space is formed between the interior area and the tongue member.

According to still another aspect of the invention the straw engaging module is formed with a plurality of interconnected vertically extending channels within the operational gap for supporting therethrough suitable drinking straws.

BRIEF DESCRIPTION OF THE DRAWINGS

FIG. 4 is a side elevational view of the drinking straw of the invention.

FIG. 5 is a top plan view of the drinking straw of the invention.

FIG. 6 is a bottom plan view of the drinking straw of the invention.

FIG. 7 is a rear perspective view illustration of the drinking straw of FIG. 1.

DETAILED DESCRIPTION OF EMBODIMENTS OF THE DISCLOSED TECHNOLOGY

Figure 1:
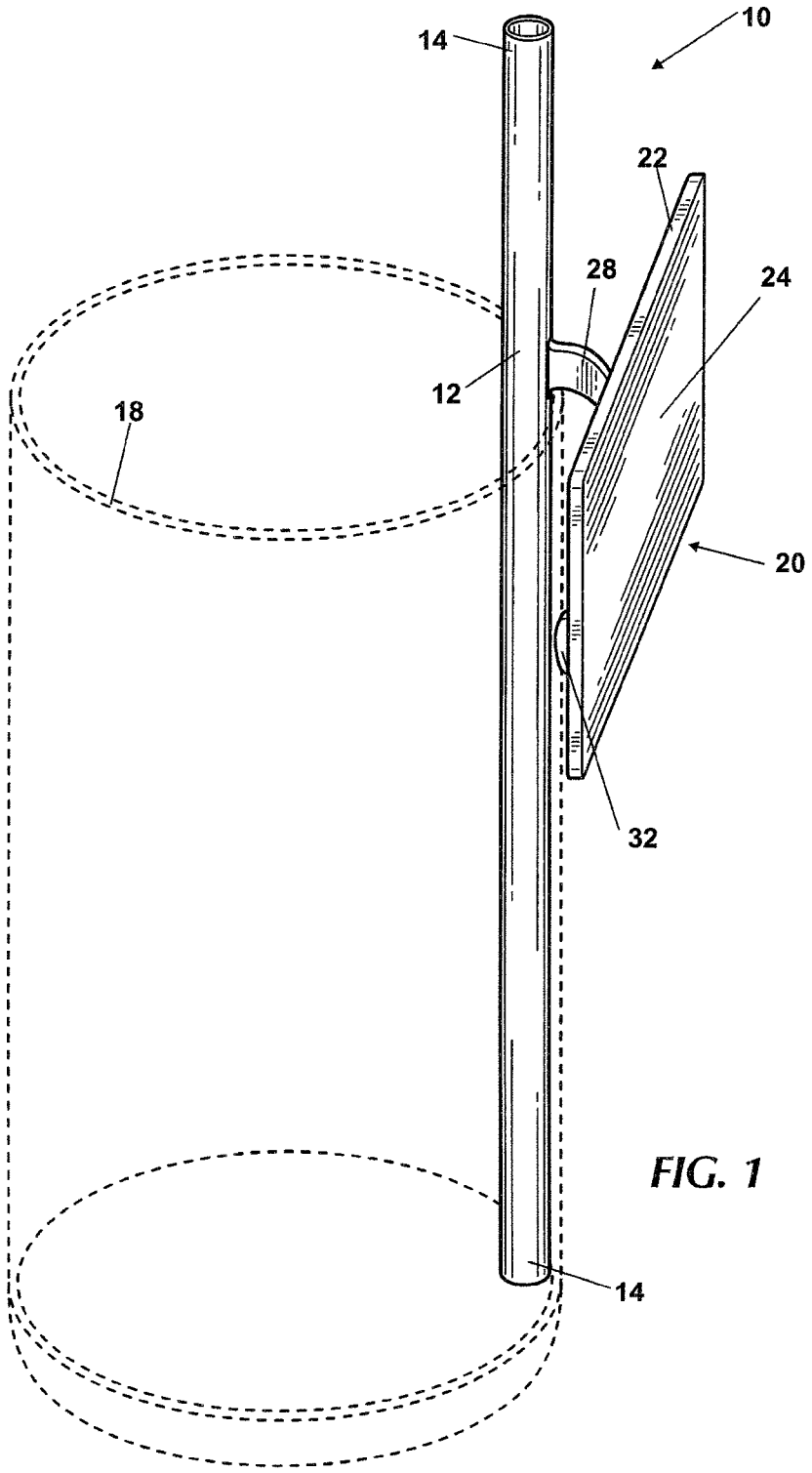
FIG. 1 is a perspective view showing a drinking straw having a display arrangement according to one embodiment of the disclosed technology, wherein the drinking straw is disposed within a drinking cup.
Figure 2:
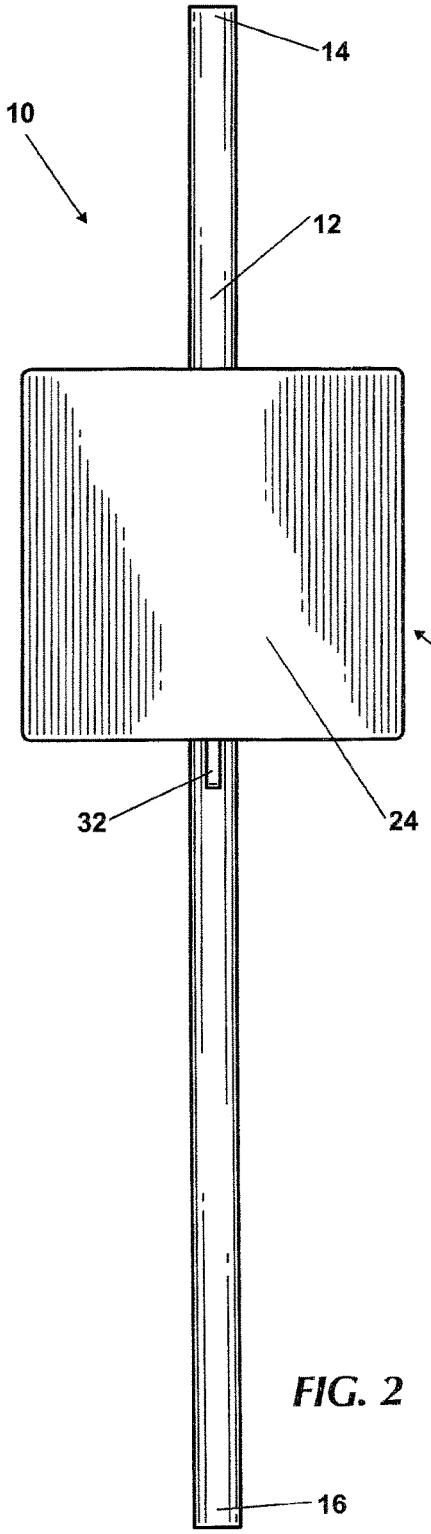
FIG. 2 is a front elevational view of the drinking straw of FIG. 1.

In an embodiment of the disclosed technology, a drinking straw has a display arrangement mounted thereon or attached thereto. The display arrangement bears graphic or language representation, such as an advertisement or any suitable graphic. When the drinking straw is disposed within a cup, the display arrangement is adapted to engage an exterior surface of the cup, so that the straw remains upright in the cup adjacent the side thereof.

According to an aspect of some embodiments of the teachings herein, there is provided a drinking straw usable for drinking beverages from a cup, the cup having an exterior surface and an interior surface surrounding a hollow, the drinking straw including a substantially cylindrical straw having a first end and a second end, and a display arrangement, including a display element having a first broad surface having a language and/or graphic representation visible thereon and a second broad surface. A straw-attachment element is attached to the second broad surface of the display element, and a cup-engaging element attached to the second broad surface of the display element in alignment with the straw-attachment element. In use the display arrangement is mounted onto the cylindrical straw, via the straw-attachment element, such that the second broad surface of the display arrangement faces the cylindrical straw and the first end of the cylindrical straw is accessible to a user for drinking therefrom. The drinking straw is disposed in the cup in such a manner that the cylindrical straw is adapted to be placed within a hollow of the cup adjacent the interior surface of the cup and the display arrangement is adapted to engage the exterior surface of the cup such that the graphic representation is disposed externally to the exterior surface and the cup engaging element engages the exterior surface.

Embodiments of the disclosed technology will become clearer in view of the following description of the drawings.

Reference is now made to FIGS. 1 to 7, which illustrate one embodiment of the teachings herein, in which a display arrangement is fixedly attached to a drinking straw.

A drinking straw 10 according to one embodiment of the invention includes a substantially cylindrical straw 12 having a first end 14 suitable for positioning in the mouth of the user, and a second end 16 adapted to be placed within a cup 18 containing a liquid or drink to be consumed by the user, such that the user draws the liquid from first end 14 into the cylindrical straw 12. Although the straw having the cylindrical configuration and circular cross-section has been illustrated, it should be noted that any conventional cross-section of the straw is within the scope of the invention. In the illustrated embodiment, the straw 12 is arranged in a straight line extending along a longitudinal axis thereof. However, straws of any conventional configuration, for example including twists, loops, or bends are within the scope of the invention.

Mounted onto straw 12 at a predetermined height thereon is a display arrangement 20. The display arrangement 20 includes a display element 22 having a first broad surface 24 facing away from the straw, and a second broad surface 26 facing toward the straw. The first broad surface 24 is adapted to display a graphic or any other representation visible to the consumer or other individuals in his or her vicinity. Although the display arrangement is shown to be fixedly positioned at a predetermined height on the straw, any position of the display arrangement on the straw is contemplated.

As seen clearly in at least FIGS. 4-7, extending from second broad surface 26 is a straw-attachment structure, attaching the display element 22 to the straw 12. In the illustrated embodiment, the straw attachment structure includes an upper arm 28 having one end fixedly attached to the second broad surface 26 and another end fixedly attached to an exterior surface of the straw 12. In some embodiments, arm 28 has a predefined preload or spring type qualities urging the display element 22 towards the straw 12.

Aligned with the upper arm 28 and extending outwardly from the lower portion of second broad surface 26, is a lower arm or cup-engaging member 30. In the embodiment of FIGS. 1-7, the cup-engaging member 30 is a protrusion extending outwardly from the lower portion of the second broad surface 26, and terminating in a convex shape, here shown as an ellipse 32. As illustrated in at least FIGS. 4 and 7, the inner ends of the upper arm 28 and the lower arm 30 connected to the second surface 26 are separated from each other by a substantial space. In one embodiment of the invention, interior surfaces of the arms facing the straw are parts of the same imaginary curve extending through the display element 22.

In use, as best illustrated in FIG. 1, when the drinking straw 10 is disposed within the cup 18, the straw 12 extends longitudinally adjacent an inner surface of the cup, while the display arrangement 20 is disposed outside of the cup. In some embodiments, see for example FIG. 1, the upper arm 28 extends over the rim of the cup, such that the second broad surface 26 is positioned adjacent an exterior surface of the cup, and the lower arm or cup-engaging element 30 engages or positioned at the very close vicinity to the exterior surface of the cup. In some embodiments, the height at which the display arrangement is disposed on the straw 12 is determined in accordance to the height of a typical cup in which the drinking straw 10 will be used, so that the upper arm 28 extends over the rim of the cup while the second end 16 of the straw 12 is adjacent the bottom of the cup and the cup engaging element 30 is aligned with the exterior surface of the cup.

In some embodiments, in view of the spring type qualities of the upper arm 28, the lower arm or cup engaging element 30 is urged inwardly toward the exterior surface of the cup 18. In this manner, the straw arrangement 10 is removably arranged on the wall of cup 18 in a predetermined position. In some embodiments, the convex shape of the element 32 engages the exterior surface of the cup at a single point.

The graphic or any other representation provided on the first broad surface 24, and visible to the consumer and other individuals in his or her vicinity, may include an advertisement, a picture, any graphic representation such as a logo, cartoon character, or mascot, an informational graphic representation such as nutritional information of the beverage in the cup, and the like. In some embodiments, the graphic representation comprises a lenticular graphic representation.

The graphic representation may be provided on the first broad surface 24 by any suitable means. In some embodiments, a graphic-representation bearing portion, such as a paper or nylon sheet is adhesively applied onto the first broad surface 24. In some embodiments, the graphic representation is printed or etched directly onto the first broad surface 24.

Figure 3:
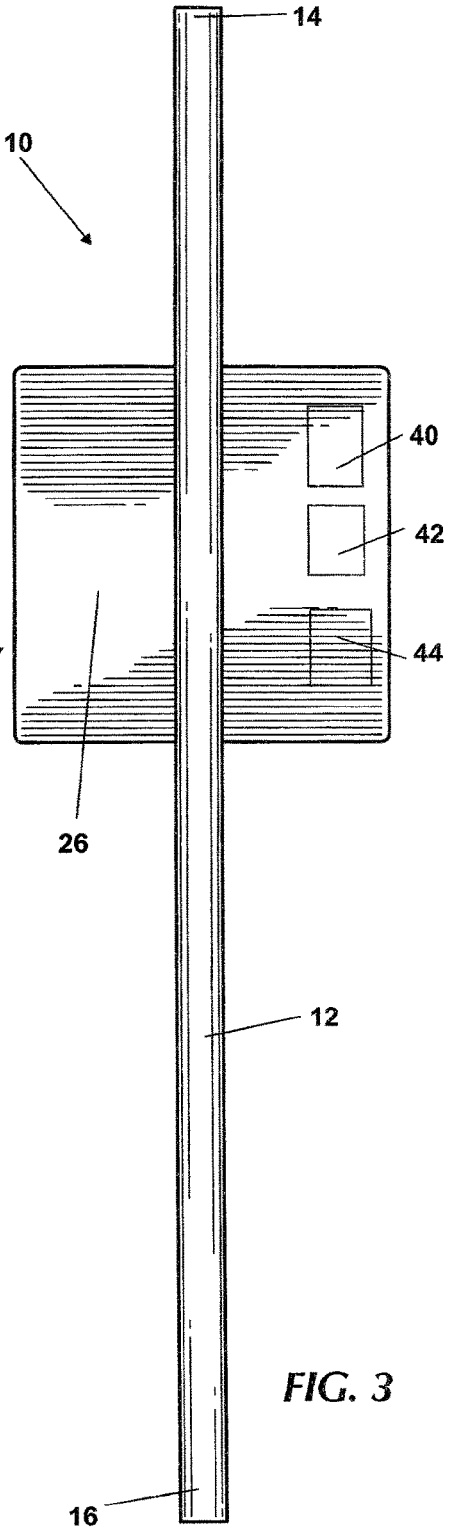
FIG. 3 is a rear elevational view of the invention.
Figure 3A:
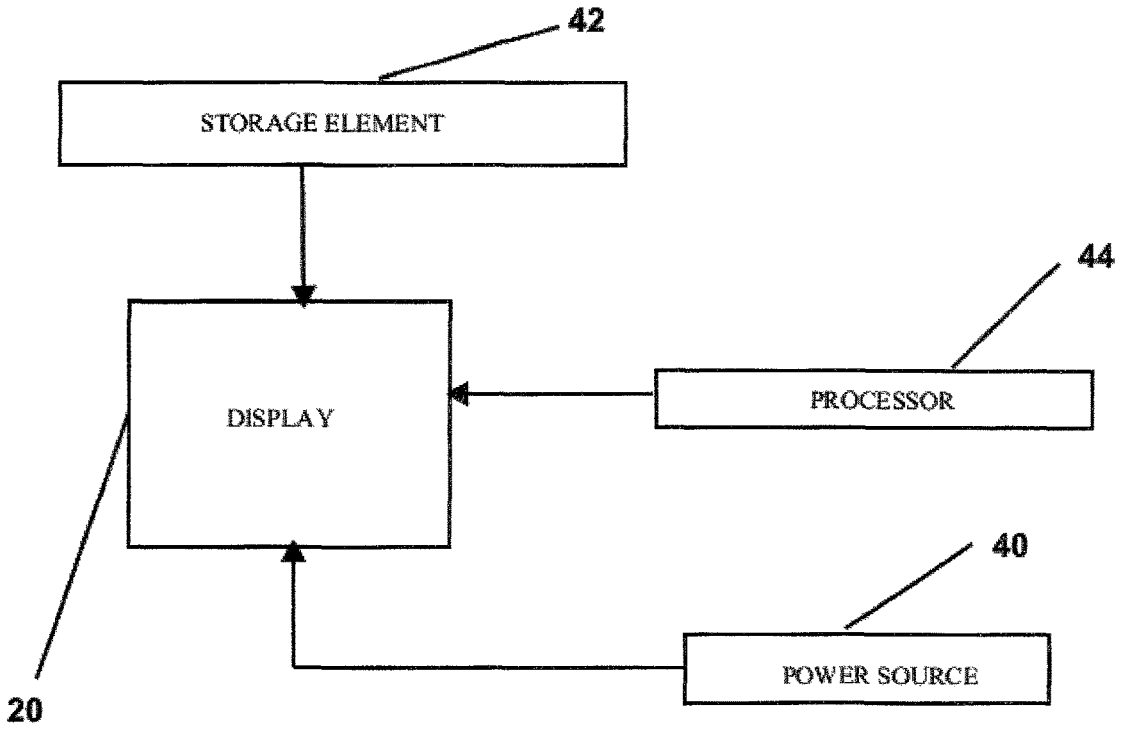
FIG. 3A is a schematic diagram representing a display arrangement.

In some embodiments, the display element 22 comprises an electronic display element. The electronic display element may comprise an LCD screen or a collection of neon or LED lights which together form a display, as often found on storefronts. In some such embodiments, as schematically illustrated in FIGS. 3 and 3A, the display arrangement 20 further includes a power source 40 adapted for powering the display element. In some embodiments, the electronic display element is functionally associated with a storage element 42, storing graphic representations and/or images to be displayed on the electronic display element, and/or with a processor 44 controlling operation of the electronic display element and the specific graphic representations to be displayed thereon.

Reference is now made to FIGS. 8 to 16, which illustrate another embodiment of the invention, in which a display arrangement adapted to adjustably accommodate various content including graphics and other materials mounted on the drinking straw.

Figure 8:
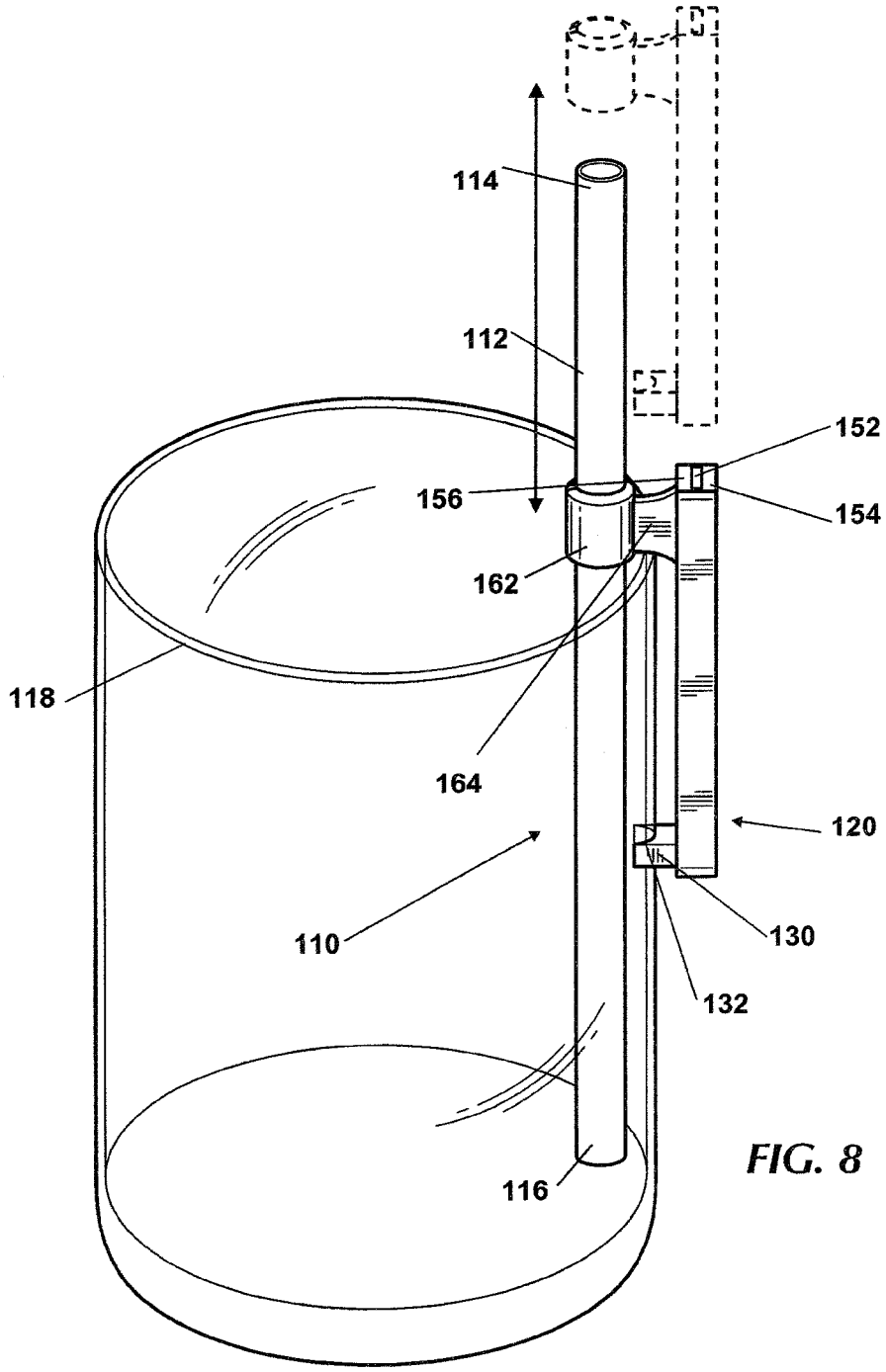
FIG. 8 is a perspective view of a drinking straw and display arrangement according to another embodiment of the disclosed technology, wherein the drinking straw is disposed within a drinking cup.
Figure 9:
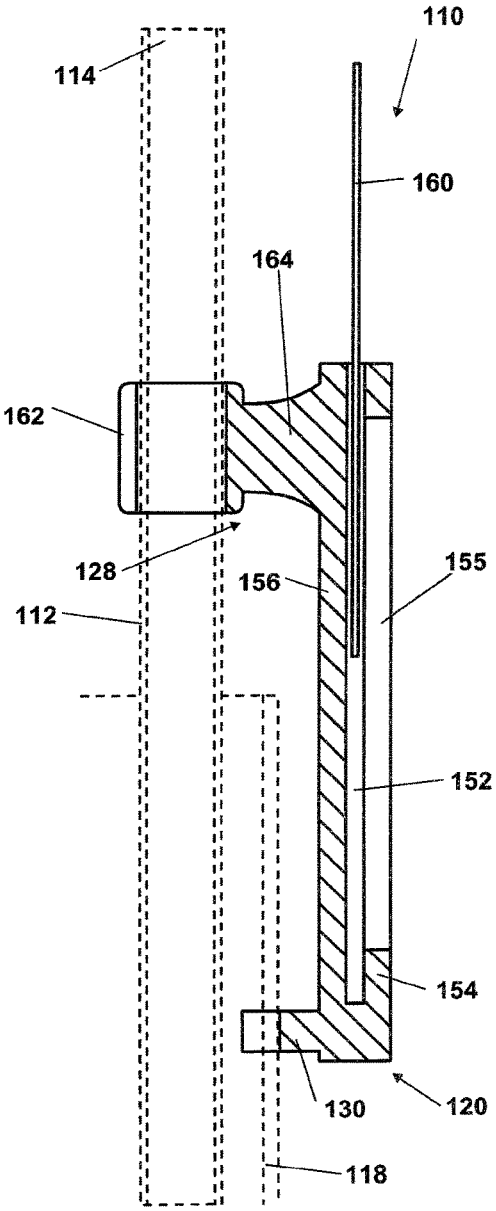
FIG. 9 is a cross sectional view of the drinking straw and display arrangement of FIG. 8.
Figure 10:
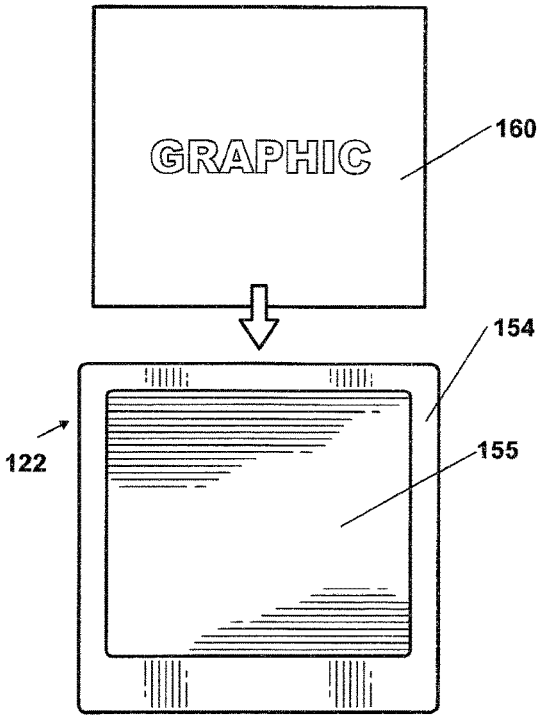
FIGS. 10 and 11 are front plan view illustrations of the display arrangement of FIG. 8 with a graphic-bearing portion disposed outside the display arrangement and within the display arrangement, respectively.
Figure 11:
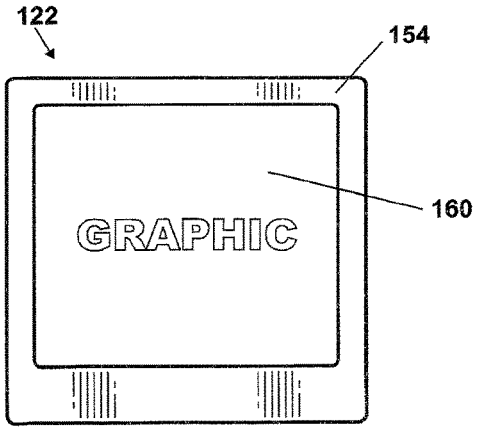
Figure 12:
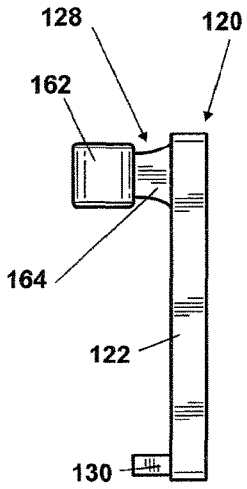
FIG. 12 is a side elevational view of the display arrangement illustrated in FIG. 8.
Figure 13:
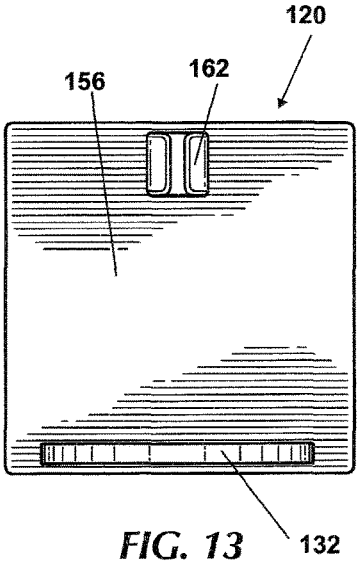
FIG. 13 is a rear elavational view of the display arrangement.
Figure 14:
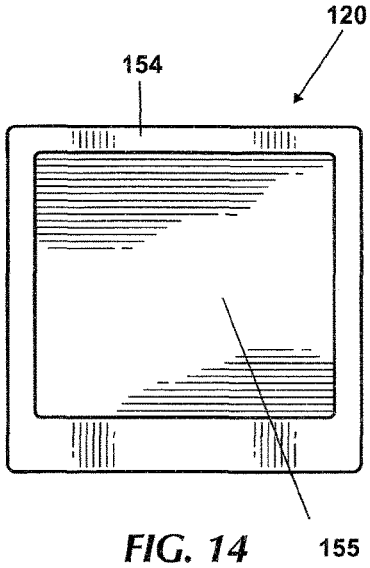
FIG. 14 is a front elavational view of the display arrangement.

As seen in FIGS. 8 and 9, a drinking straw 110 according to the illustrated embodiment includes a substantially cylindrical straw 112 having a first end 114 suitable to be positioned in the mouth of the user, and a second end 116 adapted to be placed within the liquid in a cup 118, such that the user draws the liquid from first end 114 into the cylindrical straw 112. As previously discussed, the straw 112 has a straight-line configuration extending along a longitudinal axis thereof. However, the straws of any conventional configuration including twists, loops, or bends are within the scope of the invention.

A display arrangement 120, which is adapted to be mounted onto straw 112 is illustrated in FIGS. 8 to 16. The display arrangement 120 includes a display element 122, a straw-attachment unit 128, and a cup-engagement element 130.

Figure 15:
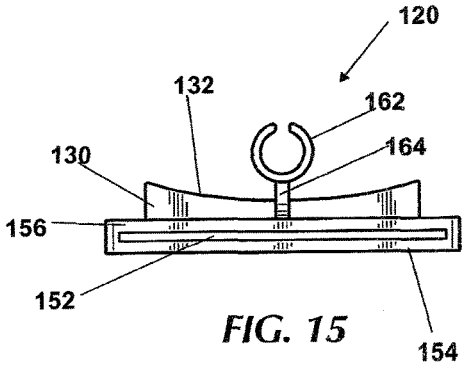
FIG. 15 is a top plan view of the display arrangement.
Figure 16:
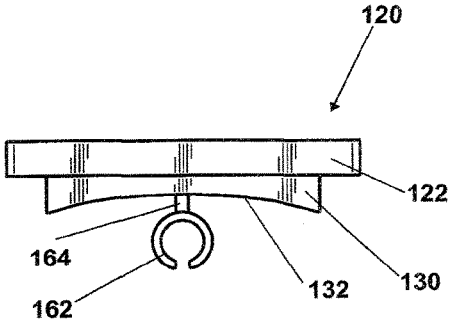
FIG. 16 is a bottom plan view of the display arrangement.
Figure 19:
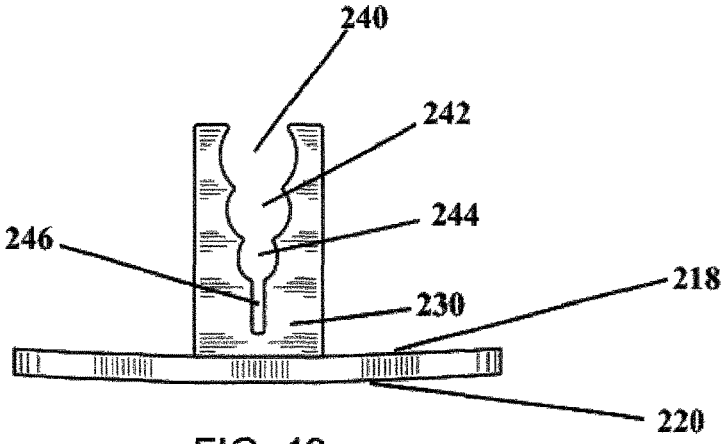
FIG. 19 is a top plan view thereof.
Figure 17:
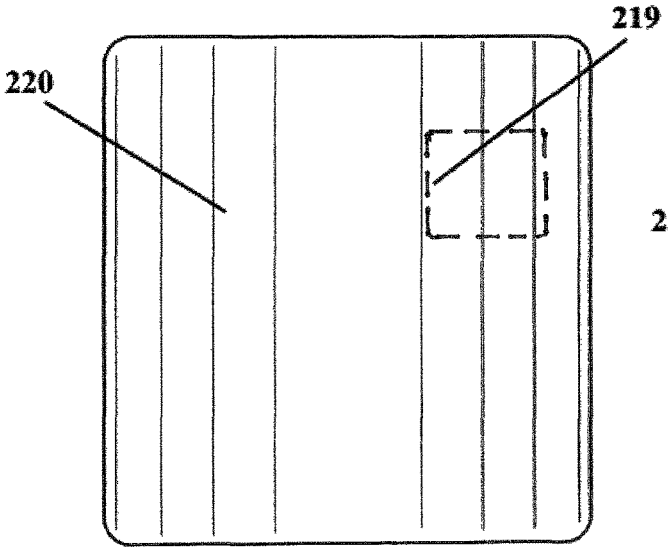
FIG. 17 is a front elevational view of a drinking straw and display arrangement according to a further embodiment of the disclosed technology.
Figure 20:
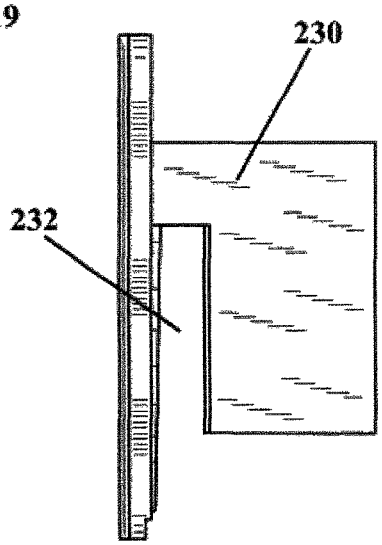
FIG. 20 is one side elevational view thereof.
Figure 18:
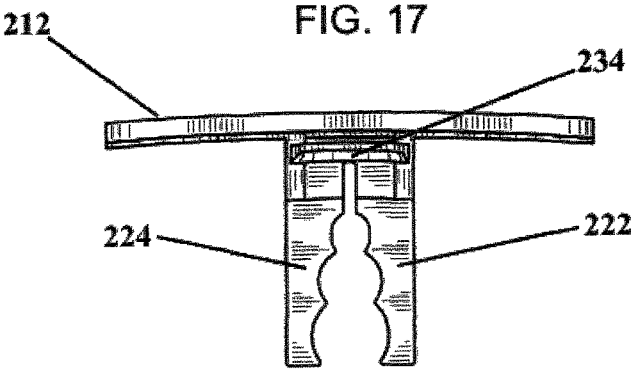
FIG. 18 is a bottom plan view thereof.
Figure 21:
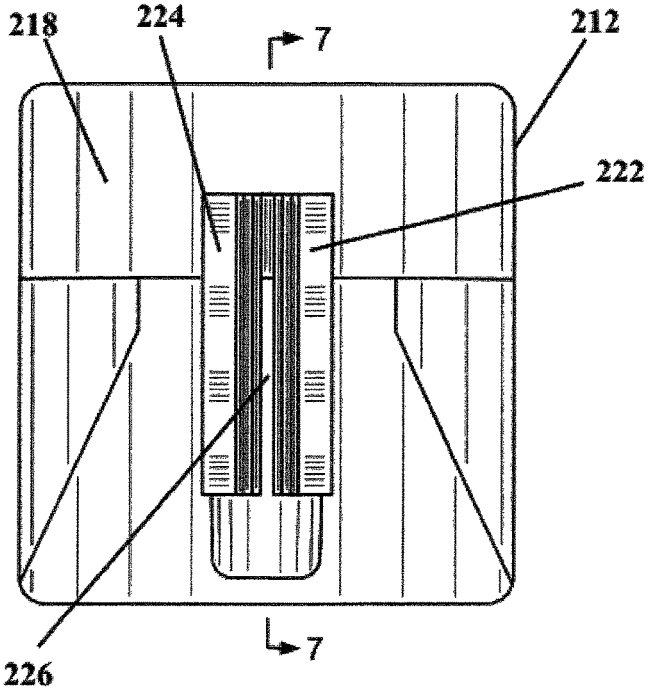
FIG. 21 is a rear elevational view thereof.
Figure 22:
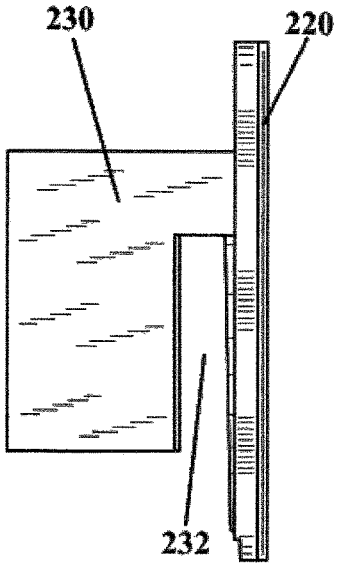
FIG. 22 is another side elevational view thereof.

As seen clearly in FIGS. 8, 9, and 15, the display element 122 includes a housing portion 150 having a hollow interior cavity 152 formed therein. The housing portion 150 includes an exterior portion 154 defining at least one transparent window 155, and an interior portion 156 adapted to face straw 112.

A content-bearing unit 160 is formed with an external region having a content representation disposed thereon and an internal region. The unit 160 is adapted to be inserted into hollow cavity 152 such that the external region displaying the content representation is visible through transparent window 155 (see FIGS. 9, 10, and 110), whereas the internal region faces the interior of the cavity 152. In this manner, the graphic or any other representation provided on the external region of the content-bearing unit 160 is visible to the consumer and other individuals in his or her vicinity.

The content representation provided on content-bearing unit 160 may be any suitable graphic or language representation, and may include an advertisement, a picture, an amusing graphic representation such as a logo, cartoon character, or mascot, an informational graphic representation such as nutritional information of the beverage in the cup, and the like. In some embodiments, the content representation is comprised of a lenticular graphic representation.

Extending from interior portion 156, at an upper portion thereof, is a straw-attachment element 128, adapted for adjustably and removably mounting display element 122 onto straw 112. The straw attachment element 128 includes a straw engaging portion 162, which is in the form of generally cylindrical opening but may form an incomplete cylindrical opening, as seen clearly in FIG. 13. The straw engaging portion 162 has an inner circumference which is substantially equal to, or slightly larger than, an outer circumference of straw 112, such that straw engaging portion 162 may be slidably mounted onto straw 112, as seen clearly in FIG. 8. A connector portion 164 connects straw engaging portion 162 to interior portion 156.

Aligned with straw engaging portion 162 and/or with connector portion 164, at a lower area of interior portion 156, is cup-engaging element 130. In the embodiment of FIGS. 8 to 16, the cup-engaging element 130 includes a protrusion extending out of interior portion 156 and formed with a curved concave surface 132 adapted to engage an exterior cylindrical surface of the cup 118.

As illustrated in FIG. 8, when the drinking straw 110 is disposed within cup 118, the straw 112 extends longitudinally adjacent an inner surface of the cup, while the display arrangement 120 is disposed outside of the cup. In some embodiments, such as the illustrated embodiment, straw engaging element 128, and specifically connector portion 164, extend over the rim of the cup, such that the interior portion 156 is disposed adjacent an exterior surface of the cup, and the cup-engaging element 130 engages the exterior surface of the cup.

In this embodiment, the height at which the display arrangement is disposed on the straw 112 is adjustable in accordance with the height of the specific cup, so that connector portion 164 extends over the rim of the cup while the second end 116 of the straw 112 is adjacent to the bottom of the cup and the cup engaging element 130 is aligned with the exterior surface of the cup. In this embodiment, the display arrangement 120 is removable from straw 112, as illustrated by dashed lines in FIG. 8. In this manner, the same display arrangement can be used with a variety of straws and vis versa.

In some embodiments, the cup-engaging element 130 is pliable, flexible, or compressible, such that the concave surface 132 is able to adapt to curvatures of the external surfaces of various cups.

The graphic representation may be provided on the first broad surface 24 by any suitable means. In some embodiments, a graphic-representation bearing portion, such as a paper or nylon sheet is adhesively applied onto the first broad surface 24. In some embodiments, the graphic representation is printed or etched directly onto the first broad surface 24.

In the alternate embodiment, the content-bearing unit 160 can be in the form of a cartridge, which comprises an electronic display element insertable into the cavity 152. The electronic display element may comprise an LCD screen or a collection of neon or LED lights which together form a display. In some embodiments, the content-bearing unit 160 is associated with a power source adapted for powering the display element. In some embodiments, the electronic display element is functionally associated with a storage element provided for storing graphic representations and/or images to be displayed on the electronic display element, and/or with a processor controlling operation of the electronic display element and the specific graphic representations to be displayed thereon.

Reference is now made to FIGS. 19 to 31, which illustrate further embodiments of the invention, wherein a display arrangement adapted to accommodate various content including graphics and other materials mounted on the drinking straw holder.

Figure 25:
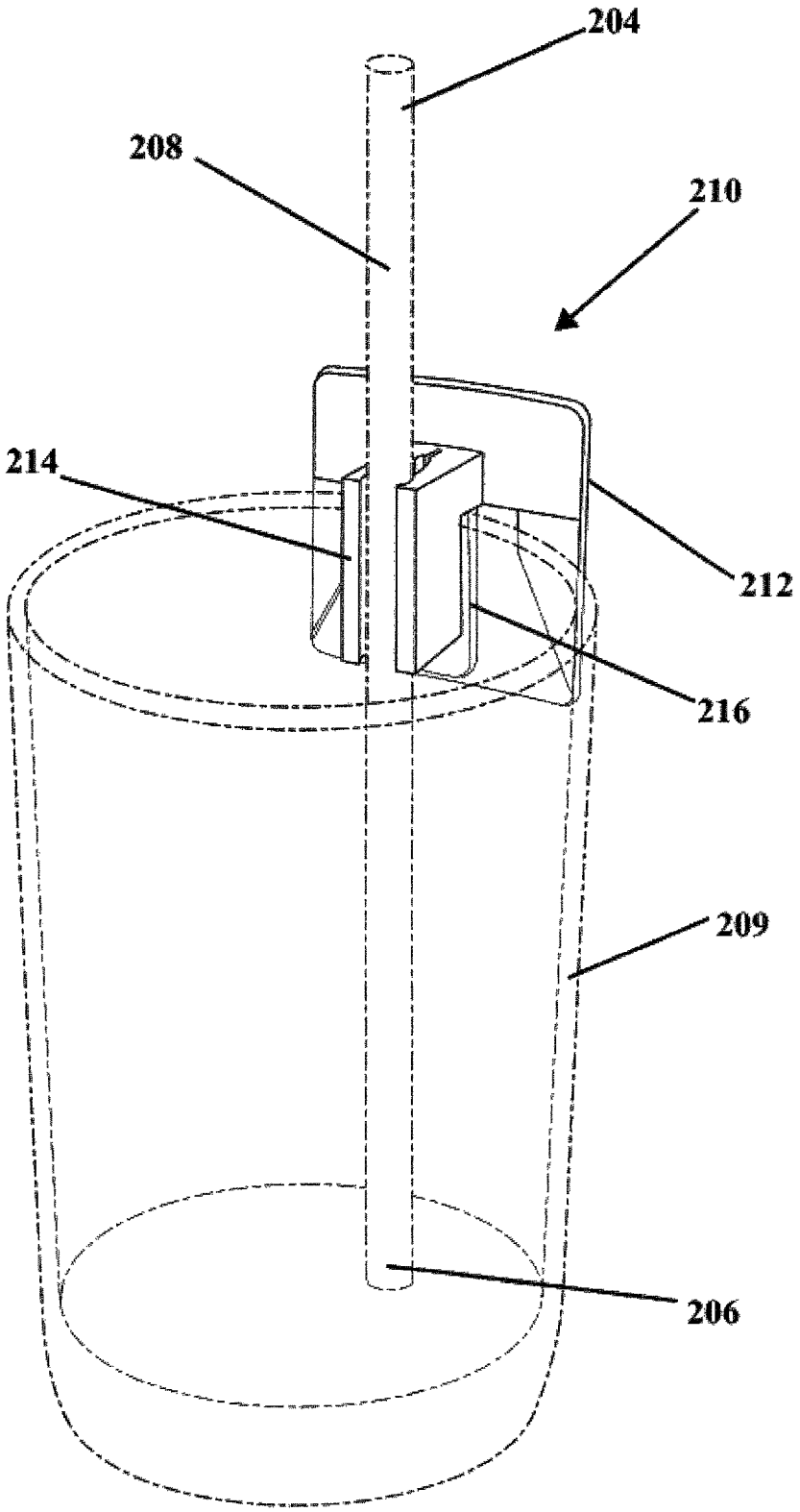
FIG. 25 is another rear perspective view thereof.
Figure 26:
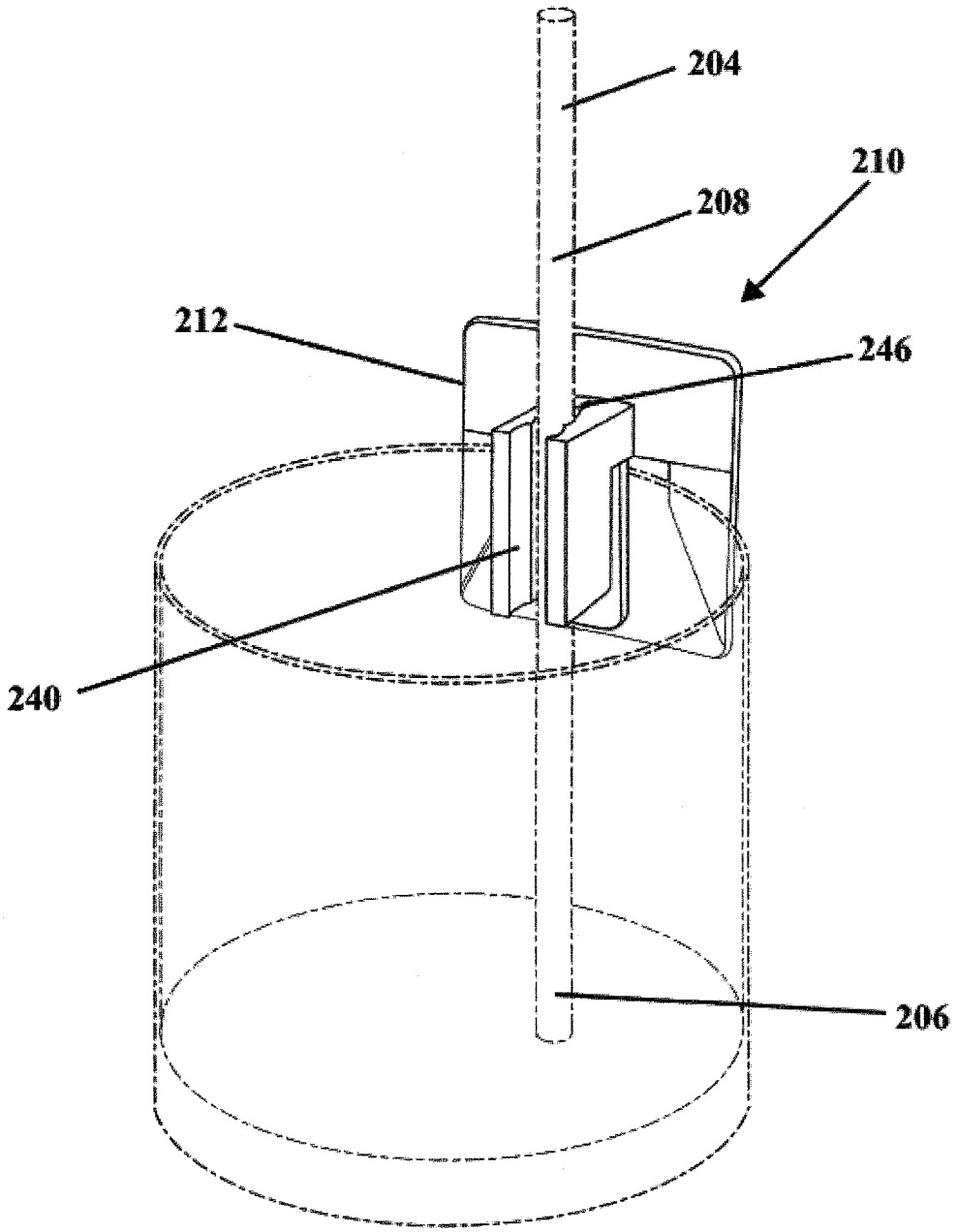
FIG. 26 is a further rear perspective view thereof.
Figure 27:
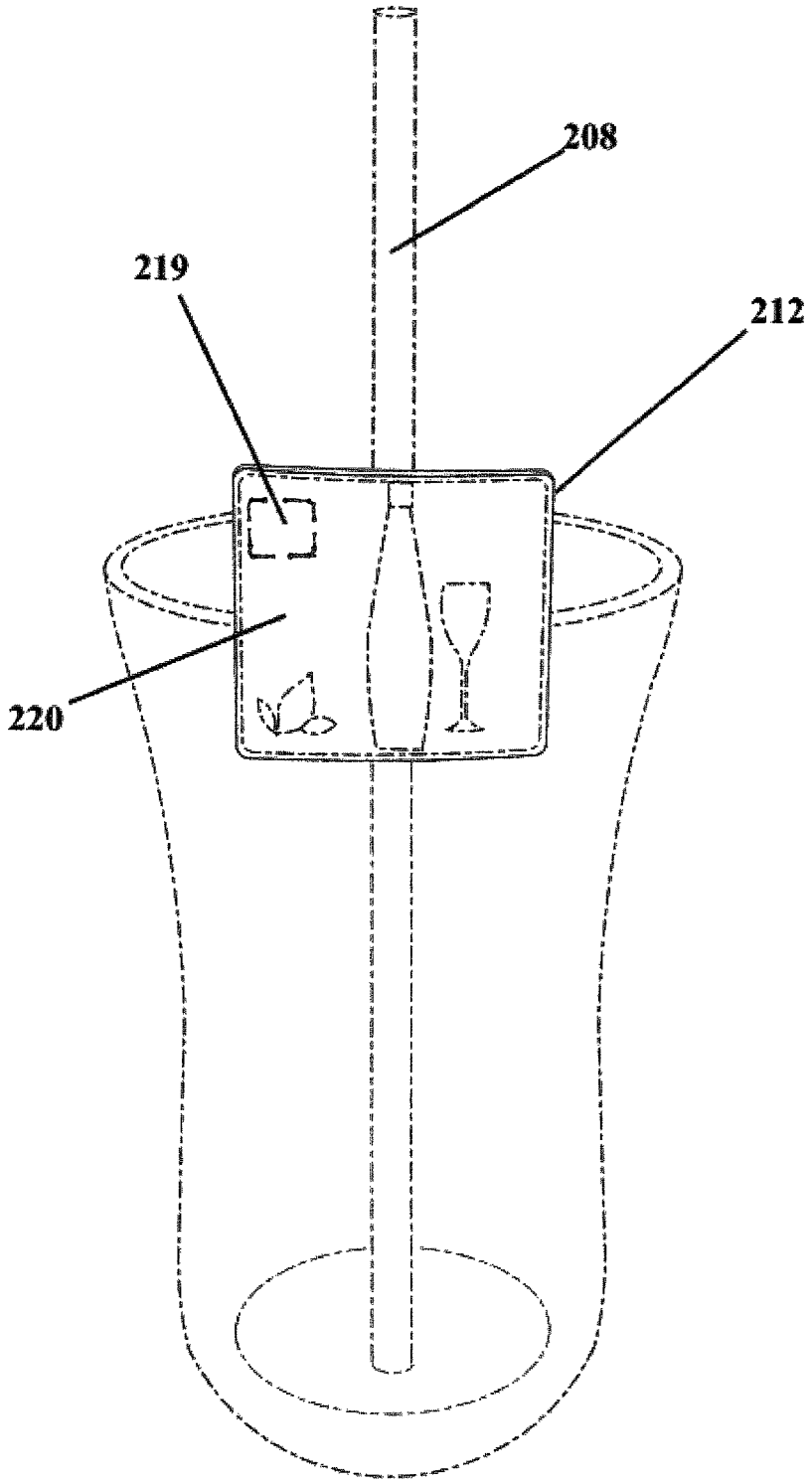
FIG. 27 is a front perspective view thereof.
Figure 28:
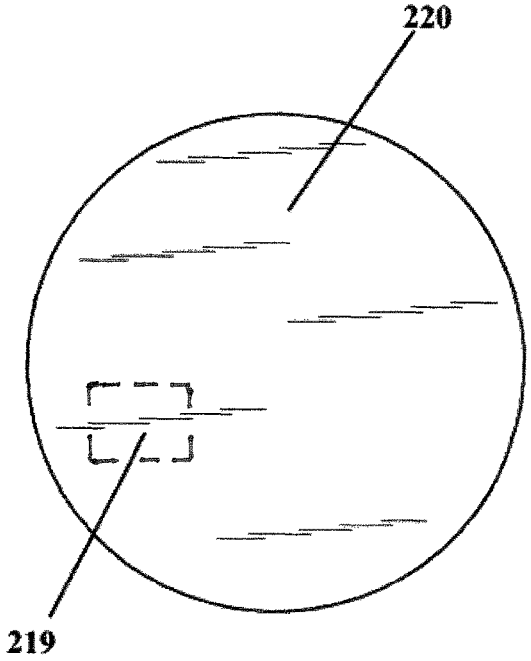
FIG. 28 is a front elevational view of a drinking straw and display arrangement according to still another embodiment of the disclosed technology.
Figure 29:
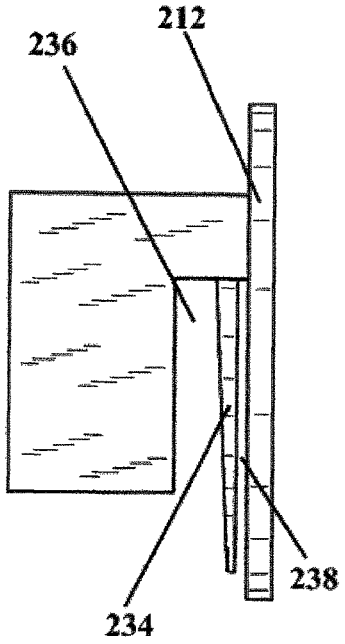
FIG. 29 is a side elevational view thereof.
Figure 30:
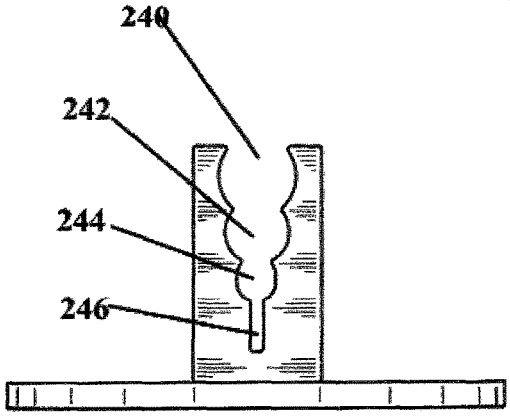
FIG. 30 is a top plan view thereof.
Figure 31:
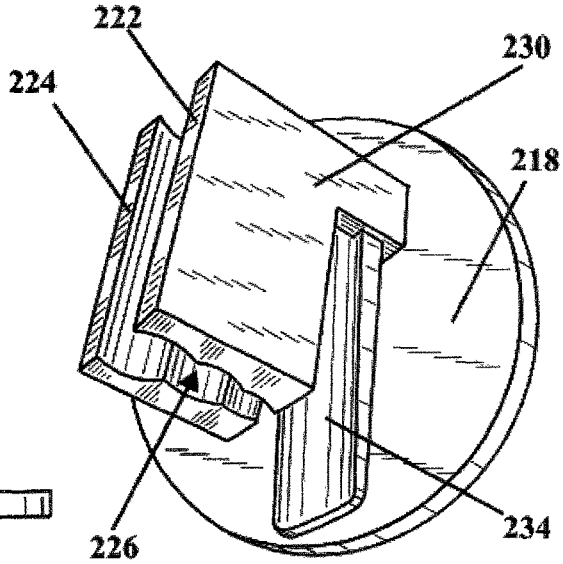
FIG. 31 is a rear perspective view thereof.

As best illustrated in FIGS. 25-27, the display arrangement 210 includes a straw 208 having a first end 204 suitable to be positioned in the mouth of the user, and a second end 206 adapted to be placed within the liquid in a cup 209, such that the user draws the liquid from first end 204 into the straw 208. As previously discussed, the straw 208 has a straight-line configuration extending along a longitudinal axis thereof. However, the straws of any conventional configuration including twists, loops, or bends are within the scope of the invention.

A display arrangement 210 is adapted to be mounted onto straw 212 and includes a display element 212, a straw-attachment module 214 with a cup-engagement unit 216. In the display element 212 content representation is provided on content-bearing unit 219 may be any suitable graphic or language representation, and may include an advertisement, a picture, an amusing graphic representation such as a logo, cartoon character, or mascot, an informational graphic representation such as nutritional information of the beverage in the cup, and the like. In some embodiments, the content representation is comprised of a lenticular graphic representation.

Figure 23:
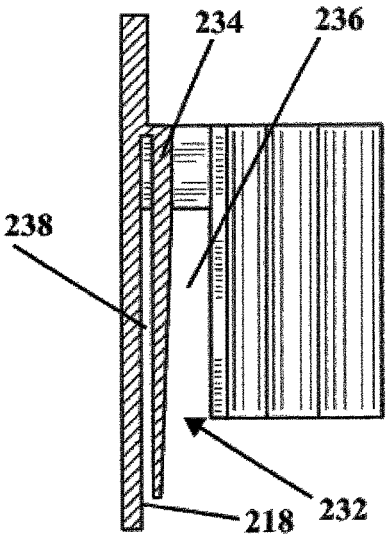
FIG. 23 is a cross-sectional view according to sectional line 23-23 of FIG. 21.
Figure 24:
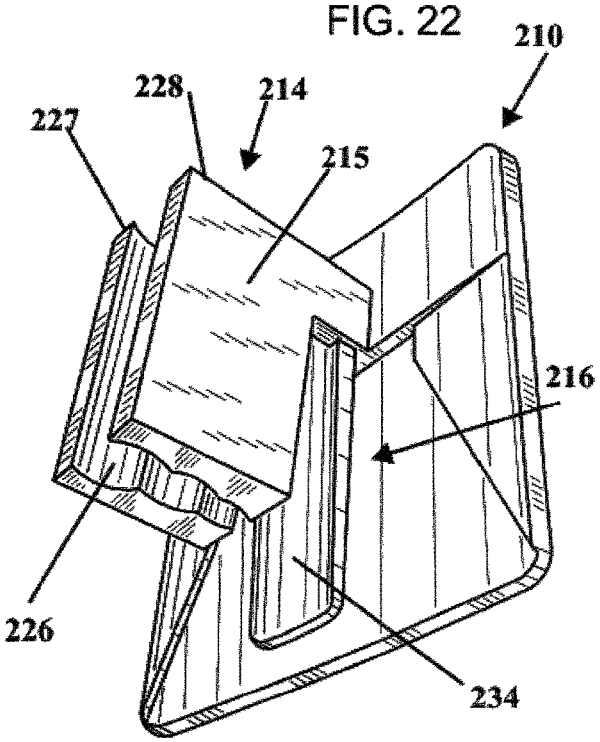
FIG. 24 is a rear perspective view thereof.

Referring now to FIGS. 19-24, wherein the display arrangement 210 having a unitary body consisting of the display element 212, the straw attachment module 214 and the cup engagement unit 216 is illustrated in a specific detail. The display element 212 is formed with a content-bearing exterior area 220 and interior area 218 accommodating a straw attachment module 214 and cup engagement unit 216. The straw attachment module 214 is formed by a first wall 222 and a second wall 224 made of a resilient material. The side walls are separated from each other by an operational gap 226. Each wall extends in a vertical direction between top and bottom portions thereof. At the side facing the display element 212 the walls 222,224 are joined by a connecting area 230 extends downwardly from the top portions of the walls and connected to the upper region of the interior area 218. The cup engagement unit 216 is formed within a longitudinal space 232 extending downwardly from the connecting area 230 and separating inner sections of the walls from the interior area 218. As best illustrated in FIGS. 23 and 24 a tongue member 234 extends downwardly from the lower part of the connecting area 230 and separates the longitudinal space 232 into a first receiving space 236 and a second receiving space 238. The first receiving space 236 is developed between the inner area of the walls and the tongue member 234. The second receiving space 238 is formed between the interior area 218 and the tongue member 234. The first receiving space 236 is wider than the second receiving space 238. Therefore, the versatility of the display arrangement 210 is being enhanced, so that glass/container having heavy and thicker wall is received within the first receiving space 236, and the glass/container having thinner wall is accommodated within the second receiving space 238. As a result, various glass/container thicknesses can be accommodated by the device of the invention and stable connection between the device and the glass is ensured.

The straw engaging module 214 is formed with a plurality of interconnected vertically extending channels 240, 242, and 244 of various diameters formed within the operational gap 226 for supporting therethrough suitable drinking straws. The operational gap 226 is open from outside and has an entrance slit adapted for passage for a drinking straw of a larger size accommodated by the invention into the first channel 240. The channels are arranged in a progression that the longitudinal channels 240 provided at the exterior of the module 214 is provided to accommodate a straw of a larger diameter, the channel 242 accommodates a straw having an intermediate diameter with the channel 244 accommodating the smallest diameter of the straw.

The straw engaging module 214 is shown and discussed with three channels. It should be obvious that the module with any reasonable number of channels is within the scope of the invention. FIG. 25 illustrates positioning of the straw 208 within the exterior longitudinal channel 240 and FIG. 26 shows positioning of the straw within the intermediate longitudinal channel 242. The straw receiving channels have an inner circumference which are substantially equal to, or slightly larger than, an outer circumference of the respective straws. In this manner the straw 208 may be slidably mounted within the respective channels, as seen clearly in at least FIGS. 25 and 26. Although the device of the invention is capable of accommodating any conventional diameter of a straw, in one embodiment the diameter of straws varies between 8.9 mm and 39 mm.

In use the drinking straw is pushed through the operational gap 226 in the direction of the glass as required by the user. When the drinking straw is consequently reaches the appropriate channel and released, due to the resiliency of the material the walls 222 and 224 are moved towards each other, and because of the elastic spring action the straw is movably locked within the corresponding longitudinal channel. The channels are typically in the form of generally cylindrical opening but may be formed having different shape.

As illustrated in FIGS. 25-27, when the drinking straw 212 is disposed within cup, the straw extends longitudinally adjacent an inner surface of the cup, while the display arrangement 210 is disposed outside of the cup. In this embodiment the straw attachment module 214, and specifically the connecting portion 230 extend over the rim of the cup, such that the interior portion 218 is disposed adjacent an exterior surface of the cup, and the cup-engaging unit 216 engages the exterior and interior surfaces of the cup.

In this embodiment, the height at which the display arrangement 210 is disposed on the straw 112 is adjustable in accordance with the height of the specific cup, so that connecting portion 230 extends over the rim of the cup while the second end 206 of the straw is adjacent to the bottom of the cup and the cup engaging element 216 is aligned with the exterior surface of the cup. In this embodiment, the display arrangement 210 is removable from straw 208. In this manner, the same display arrangement can be used with a variety of straws and vis versa.

In the embodiment of FIGS. 19-27 the display arrangement 210 is illustrated with the display element 212 having a rectangular or square configuration with a slight curvature. In the embodiment of FIGS. 28-31 the display arrangement 210 is illustrated with the display element 212 being substantially flat and having a circular shape. In other respects, the design of these embodiments is substantially similar. It should be also noted that the display arrangement 210 with any shape of the display element, such as for example an oval-shaped or other custom-made design are clearly within the scope of the invention.

The graphic representations can be provided at the exterior front surface 218 of the display element 212 by any suitable means. In some embodiments, a graphic-representation bearing portion, such as a paper or nylon sheet is adhesively applied onto the surface 218. In some embodiments, the graphic representation is printed or etched directly onto the exterior surface 218.

In the alternate embodiment, the display element 212 includes content-bearing unit 219 can be in the form of a cartridge, which comprises an electronic display element forming a part of the display element body. The electronic display element may comprise an LCD screen or a collection of neon or LED lights which together form a display. Similar to the embodiment of FIGS. 3 and 3A the content-bearing unit 219 is associated with the power source 40 adapted for powering the display element. In some embodiments, the electronic display element is functionally associated with a storage element 42 provided for storing graphic representations and/or images to be displayed on the electronic display element, and/or with a processor 44 controlling operation of the electronic display element and the specific graphic representations to be displayed thereon. In a further embodiment the content-bearing electronic unit 219 includes imbedded microprocessor or chip adaptable for cooperation with any types of information technology (IT) such as computers, storage, networking and other physical devices, infrastructure and processes to create, process, store, secure and exchange all forms of electronic data containing the required graphic representations. The IT system associated with the microprocessor of the content-bearing unit 219 may include additional virtualization and management or automation tools, operating systems and applications or software used to perform essential functions. User devices, peripherals and software, such as laptops, smartphones or even recording equipment, can be included in the operation of IT domain of the unit 219. The graphic representations or any other information data utilized by the content-bearing unit 219 can be gathered and communicated to and from the display element 212 by various types of wireless communication including but not limited by 3 and 4G networks, Bluetooth, Wi-Fi technologies, etc.

It has been discussed above that the present invention provides a drinking straw with a display arrangement capable of displaying language and/or any graphic information visible to a user or other individuals in his or her vicinity, that can be attached to the side of a cup and, while the user is drinking from the straw.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A drinking straw holding device with a display arrangement, comprising:

a unitary body having a display element, a straw attachment module and a cup engagement unit, the display element is formed with a content-bearing exterior area and an interior area accommodating the straw attachment module and the cup engagement unit;

the straw attachment module extends between a rear region connected to the interior area of the display element and a front region, the straw attachment module is formed by a first wall and a second wall partially separated from each other at the front region by an operational gap; at the rear region the first and second walls are joined by a connecting area connected to the interior area;

the cup engagement unit is formed within a longitudinal space extending downwardly from the connecting area and separating the first and second walls from the interior area, and a tongue member extends downwardly from the connecting area to separate the longitudinal space into a first receiving space and a second receiving space.

2. The drinking straw holding device with the display arrangement of claim 1, wherein the first receiving space is formed between an inner area of the walls and the tongue member and the second receiving space is formed between the interior area and the tongue member.

3. The drinking straw holding device with the display arrangement of claim 2, wherein the first receiving space is wider than the second receiving space, so that a glass having a thicker wall is received within the first receiving space, and a glass having thinner wall is received within the second receiving space.

4. The drinking straw holding device with the display arrangement of claim 1, wherein the straw engaging module is formed with a plurality of interconnected vertically extending channels within the operational gap for supporting therethrough suitable drinking straws.

5. The drinking straw holding device with the display arrangement of claim 4, wherein, the channels are arranged in a progression that the longitudinal channels provided at the exterior of the module receives a straw of a larger diameter, a middle channel receives a straw having an intermediate diameter, with an inner channel accommodating the smallest diameter of the straw.

6. The drinking straw holding device with the display arrangement of claim 5, wherein, said channels having inner circumferences approximately equal to an outer circumference of a straw.

7. The drinking straw holding device with the display arrangement of claim 4, wherein, said generally cylindrical straw-engaging channels adapted to be slidably and removably disposed about a cylindrical straw, such that said display arrangement is slidably and removably mounted onto said cylindrical straw.

8. The drinking straw holding device with the display arrangement of claim 1, wherein, said graphic representation is adhesively applied onto said front surface.

9. The drinking straw holding device with the display arrangement of claim 1, wherein, said graphic representation is printed onto, or otherwise forms an integral part of, said front surface.

10. The drinking straw holding device with the display arrangement of claim 1, wherein, said display element comprises an electronic display element adapted to electronically display said graphic representation.

11. The drinking straw holding device with the display arrangement of claim 1, wherein, said display arrangement further includes a power source powering said electronic display element.

12. The drinking straw holding device with the display arrangement of claim 1, wherein, said display arrangement further includes a processor, adapted to control operation of said electronic display element and of said graphic representation displayed thereon.

13. The drinking straw holding device with the display arrangement of claim 1, wherein said display arrangement is mounted onto a straw, via said straw-attachment element, such that said inner surface of said display element faces said straw and a first end of said straw is accessible to a user for drinking therefrom, and wherein, when said drinking straw is disposed in the cup, said straw is adapted to be placed within the hollow of the cup adjacent the interior surface of the cup and said display arrangement is adapted to engage the exterior surface of the cup such that said language or graphic representation is disposed externally to the exterior surface and said cup-engaging element engages the exterior surface.

14. A drinking straw usable for drinking a beverage from a cup, the cup having an exterior surface and an interior surface surrounding a hollow, the drinking straw comprising:

a straw having a first end and a second end; and a display arrangement, comprising:

a display element having a front surface capable of displaying a language or graphic representation visible thereon and a second broad surface;

a straw-attachment module attached to inner surface of said display extends between a rear region connected to the interior area of the display element and a front region, the straw attachment module is formed by a first wall and a second wall partially are separated from each other at the front region by an operational gap; at the rear region the first and second walls are joined by a connecting area connected to the interior area; and a cup-engaging element connected to interior surface of said display element in alignment with said straw-attachment element, said cup-engaging element comprises a longitudinal space extending downwardly from the connecting area and separating the first and walls from the interior area, and a tongue member extends downwardly from the connecting area to separate the longitudinal space into a first receiving space and a second receiving space;

wherein said display arrangement is mounted onto said straw, via said straw-attachment element, such that said inner surface of said display element faces said straw and said first end of said straw is accessible to a user for drinking therefrom, and wherein, when said drinking straw is disposed in the cup, said straw is adapted to be placed within the hollow of the cup adjacent the interior surface of the cup and said display arrangement is adapted to engage the exterior surface of the cup such that said language or graphic representation is disposed externally to the exterior surface and said cup-engaging element engages the exterior surface.

* * * * *